United States Patent [19]

Gottschlich

[11] 4,109,790

[45] Aug. 29, 1978

[54] SUPPORTING COVER FOR AN INK ROLL MEANS

[75] Inventor: James A. Gottschlich, Bellbrook, Ohio

[73] Assignee: NCR Corporation, Dayton, Ohio

[21] Appl. No.: 806,226

[22] Filed: Jun. 13, 1977

[51] Int. Cl.[2] ..... B65D 85/54; B65D 13/00

[52] U.S. Cl. ..... 206/446; 101/376; 206/408; 220/4 B

[58] Field of Search ..... 206/446, 409, 408, 410, 206/45.33; 220/4 E, 4 B, 339; 150/42; 225/47; 101/376

[56] References Cited

U.S. PATENT DOCUMENTS

| | | | |
|---|---|---|---|
| 2,462,776 | 2/1949 | Price | 225/47 |
| 2,639,807 | 5/1953 | Ambrette et al. | 206/446 |
| 2,828,857 | 4/1958 | MacKay | 206/446 |
| 3,280,870 | 10/1966 | Bundy | 150/42 |
| 3,363,748 | 1/1968 | Hood | 206/45.33 |
| 3,402,806 | 9/1968 | Sutherland et al. | 220/339 |
| 4,034,926 | 7/1977 | Wegner | 220/4 E |

FOREIGN PATENT DOCUMENTS

| | | | |
|---|---|---|---|
| 260 of | 1914 | United Kingdom | 206/408 |

*Primary Examiner*—William T. Dixson, Jr.
*Attorney, Agent, or Firm*—J. T. Cavender; Albert L. Sessler, Jr.; Elmer Wargo

[57] ABSTRACT

A supporting cover for a porous rubber ink roll used, for example, on a printing machine. The cover is formed of first and second sections or halves which are joined together by an integrally-formed hinge which enables the cover to be formed of a one-piece construction from polypropylene plastic. The cover incorporates locking features to prevent the cover from being readily opened when the ink roll is stored and shipped therein. Each of the halves of the cover has a portion which is removed therefrom to enable the ink roll to be exposed from the cover when the ink roll and cover are installed on a utilization device such as a printing machine. The cover has projections on a side thereof which coact with the printer to prevent the cover from being rotated while it is installed on the printer.

11 Claims, 4 Drawing Figures

SUPPORTING COVER FOR AN INK ROLL MEANS

BACKGROUND OF THE INVENTION

This invention relates to a supporting cover for an ink roll means which may be used on a utilization device such as a printer.

One of the problems with ink roll means especially of the porous ink roll type is that they are messy to handle and use. They are messy during shipment to a customer, during installation on a machine, and during use on that machine.

The present invention obviates these problems in that it provides a low cost cover for shipping and handling a porous ink roll, and it also provides a support for the ink roll means when the ink roll means is installed on a utilization device such as a printer. The supporting cover of this invention is low in cost and is made of a single piece of polypropylene plastic. The supporting cover also provides a convenient package for shipping the porous ink roll therein.

A prior art receptacle for shipping items therein is shown in U.S. Pat. No. 3,280,870; however, this receptacle is not designed to be used as both a shipping container and a dispensing container. Also, this receptacle is not designed to coact with a utilization device as is done with the supporting cover of this invention.

SUMMARY OF THE INVENTION

This invention relates to a supporting cover for an ink roll means. The supporting cover includes first and second halves and a hinge means which enables the first and second halves to be moved relative to each other to form a generally, cylindrically-shaped, hollow container when in assembled relationship to receive the ink roll means therein. The first and second halves have means therein for supporting the ink roll means in the supporting cover formed thereby. At least one of the first and second halves has a portion thereof which is removed therefrom to expose a portion of the ink roll means when the ink roll means is mounted in the supporting cover. The supporting cover also has means thereon for restraining the movement thereof when the supporting cover is installed on a cooperating utilization device such as a printer.

DETAILED DESCRIPTION OF THE INVENTION

Figure 1:
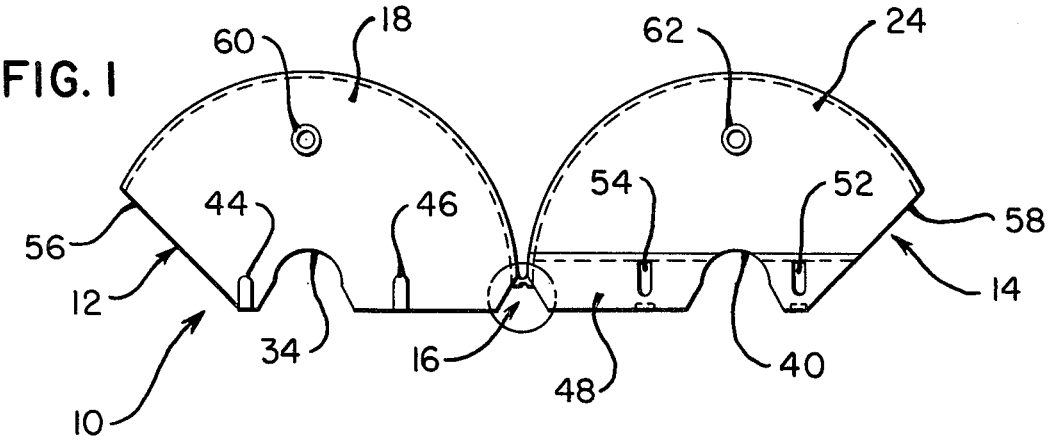
FIG. 1 is a side view in elevation of the first and second halves of the supporting cover of this invention and the integrally formed hinge means which connects the first and second halves.

The supporting cover 10 of this invention is shown in blank form in FIG. 1 after it has been molded into the shape shown. The cover 10 may be made of moldable plastics such as polypropylene plastic, and it may be molded by conventional molding techniques, such as injection molding.

The cover 10 includes the first half or section 12 and the second half or section 14 which are integrally joined to each other along the hinge means 16. The first half 12 includes the first and second end walls 18 and 20, respectively, which are spaced apart in parallel relationship as shown. The curved wall 22 is integrally formed with the end walls 18 and 20 to form a half of a cylindrical section as shown.

Figure 2:
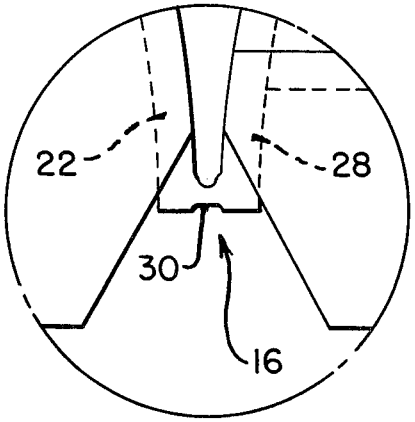
FIG. 2 is an enlarged view of the hinge means shown in the circle in FIG. 1.
Figure 4:
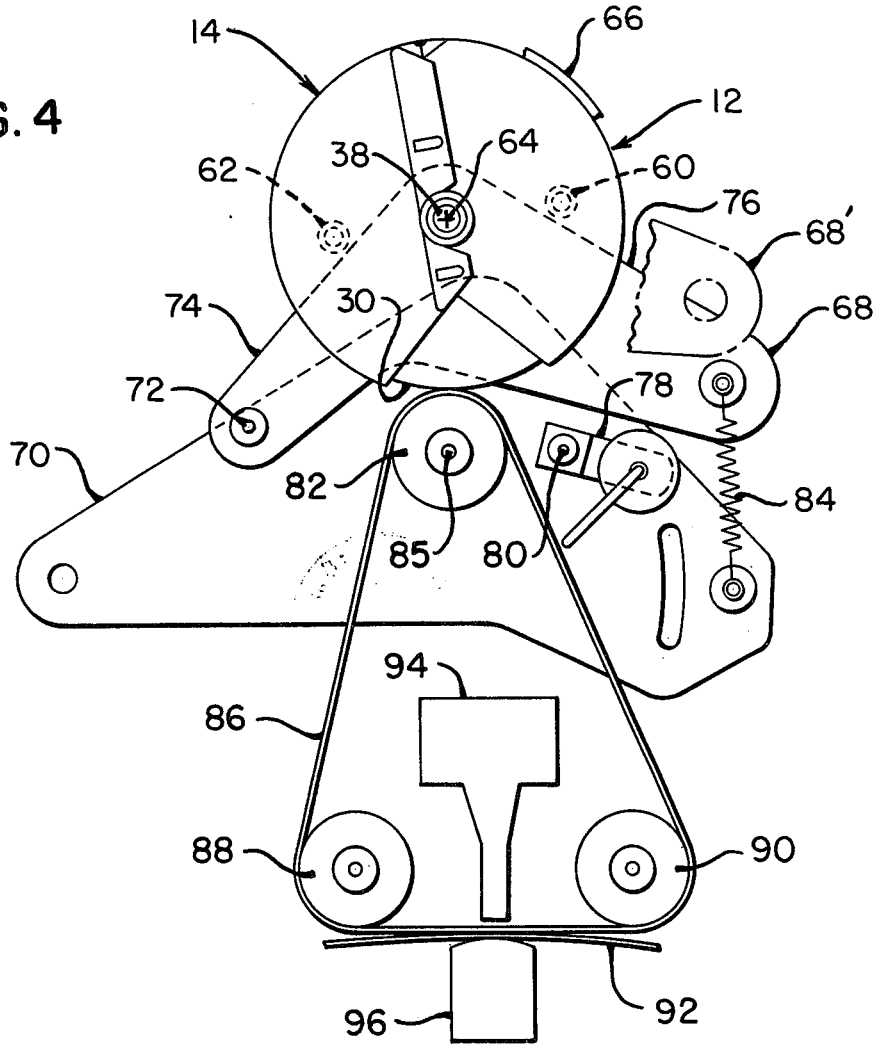
FIG. 4 is a side view in elevation of the supporting cover of this invention, with the first and second halves of the supporting cover being shown in assembled relationship, and with an ink roll means being supported in said supporting cover. This figure also shows how the supporting cover of this invention coacts with a utilization device such as a printer.

Similarly, the second half 14 includes the first and second end walls 24 and 26, respectively, which are spaced apart in parallel relationship as shown. The curved wall 28 is integrally formed with the first and second end walls 24, 26 as shown to form a half of a cylindrical section. The curved walls 22 and 28 terminate in the hinge means 16, as is best shown in FIG. 2. The hinge means 16 includes a narrowed section at 30 which enables the first and second halves 12 and 14 to be moved relative to each other to form a generally, cylindrically-shaped, hollow container as is best shown in FIG. 4. Because the hinge means 16 may be conventional, it need not be described any further.

The cover 10 is used to rotatably support therein the ink roll means 30 shown in FIG. 4. In this regard, the first half 12 has aligned opposed areas therein wherein semicircular portions thereof are removed therefrom as at areas 34 and 36 in end walls 18 and 20, respectively, to receive the supporting rod 38 which rotatably supports the ink roll means 30 in the supporting cover 10 when the supporting cover 10 is assembled and mounted on the supporting rod 38 as shown in FIG. 4. The second half 14 has similar semicircular portions removed therefrom as at areas 40 and 42 for the purpose already described. When the first and second halves 12 and 14 are moved into the assembled relationship shown in FIG. 4, the semicircular cut out portions as at areas 34 and 40 in FIG. 1 combine to form a complete circle or hole into which one end of the supporting rod 38 is inserted. The same is true for the semicircular cut out portions at areas 36 and 42; these two areas provide a bearing surface for the opposite end of the supporting rod 38.

Figure 3:
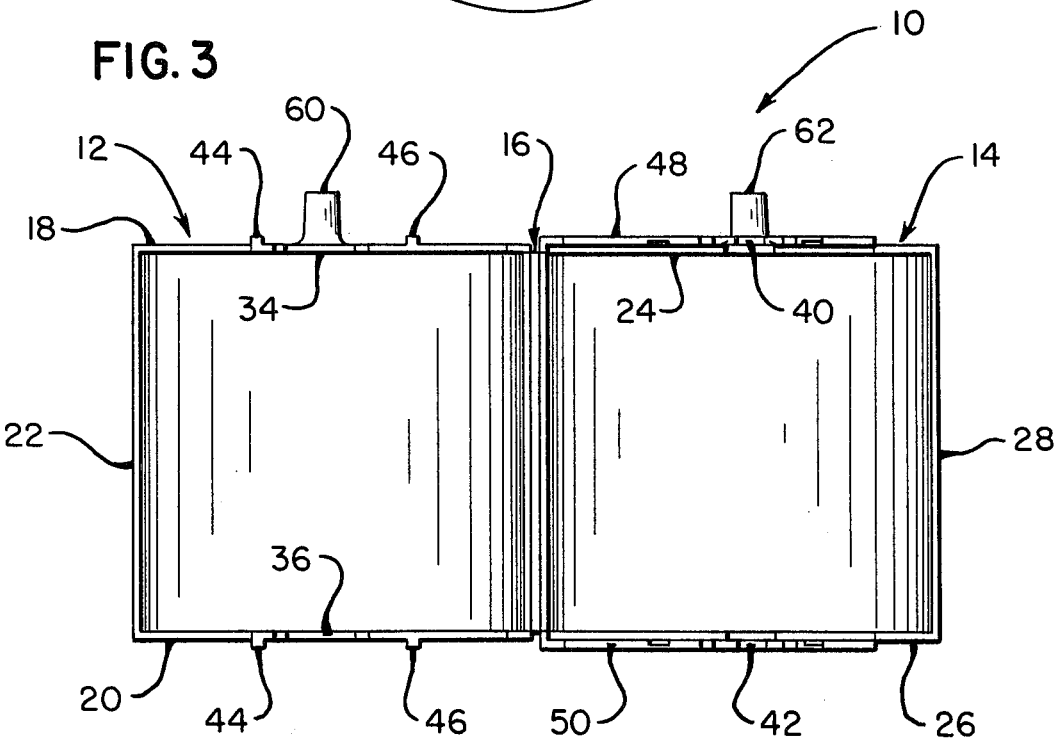
FIG. 3 is a plan view of the first and second halves of the supporting cover shown in FIG. 1.

The cover 10 also has means for locking the first and second halves 12 and 14 in the assembled relationship shown in FIG. 4. This means includes the projections 44 and 46 which extend outwardly from the first and second end walls 18 and 20, respectively, of the first half 12 as shown in FIGS. 1 and 3. The second half 14 has plates 48 and 50 integrally formed with the end walls 24 and 26, respectively, as shown in FIGS. 1 and 3. The plates 48 and 50 have complementary recesses 52 and 54 therein (FIG. 1) which receive the projections 44 and 46, respectively, when the first and second halves 12 and 14 are moved into the assembled relationship shown in FIG. 4. The plates 48 and 50 are slightly offset from their related end walls 24 and 26, respectively, so as to enable the end walls 18 and 24 to be aligned with each other and the end walls 20 and 26 to be aligned with each other when the first and second halves 12 and 14 are moved into the assembled relationship shown in FIG. 4. The first and second halves 12 and 14 are somewhat flexible so as to enable the first and second end walls 18 and 20 of the first half 12 to be moved towards each other so as to enable the projections 44 and 46 to be moved into their complementary recesses 52 and 56 as previously explained to lock the first and second halves 12 and 14 together.

The cover 12 has portions which are removed therefrom so as to enable a portion of the ink roll means 30 to be exposed therefrom when an ink roll means 30 is installed in the cover 10 as shown in FIG. 4. In this regard, a portion of the first half 12 is removed at area 56 in FIG. 1, and similarly a portion of the second half 14 is removed at area 58. When these two halves 12 and 14 are in the assembled relationship shown in FIG. 4, a sector portion of the cover 12 is formed thereby to enable the ink roll means 30 to be exposed. Naturally, for certain applications, a sector portion may be removed from only one of the first and second halves 12, 14 if found necessary or desirable.

The cover 10 also has means thereon for restraining the rotation of the cover 10 when it is installed on a utilization device such as a portion of a printer shown in FIG. 4. For this embodiment, the restraining means takes the form of projections 60 and 62 which extend outwardly from the end walls 18 and 24, respectively. When the cover 12 is in the assembled relationship shown in FIG. 4, the projections 60 and 62 lie along a diametral line which passes through the longitudinal axis 64 of the cover 12. The supporting rod 38 for the ink roll means 30 also has a longitudinal axis which is coincident with the longitudinal axis 64 of the cover 12, when the cover 12 with the ink roll means therein is mounted on the supporting rod 38.

The cover 12 with the ink roll means 30 therein may be encapsulated in a layer of plastic 66, only a portion of which is shown in FIG. 4. The package formed by the cover 12, the ink roll means 30 and the layer of encapsulating plastic 66 provide a neat package for shipping and handling.

When the ink roll means 30 is to be installed on a utilization device such as the portion of the printer shown in FIG. 4, the encapsulating layer of plastic 66 is simply removed and the cover 12 with the ink roll means 30 therein is simply pushed onto the supporting rod 38. The supporting rod 38 has one end thereof which is fixed to the lever 68 in cantilever fashion. The lever 68 has one end thereof pivotally secured to the frame member 70 by the mounting pin 72. The lever 68 has sides 74 and 76 which are angled as shown so as to contact the projections 60 and 62 extending from the cover 12 when the cover 12 and ink roll means 30 are mounted on the supporting rod 38. These projections 60 and 62 coact with the lever 68 to prevent the cover 12 from rotating while it is positioned on the supporting rod 38. In order to facilitate the insertion of the ink roll means 30 with its cover 12 on the supporting rod 38, the lever 78 (which is pivotally mounted on the pin 80 which is secured to the side frame 70) may be rotated in a counterclockwise direction so as to pivot the lever 68 on its pin 72 in a counterclockwise direction (as viewed in FIG. 4) so as to move the lever 68 to the dashed position shown at 68[1]. When the lever 68 is in this position, the ink roll means 30 is separated from the inking roller 82 which is part of the printer. This enables an old ink roller means 30 with supporting cover 12 to be removed from the supporting rod 38 and facilitates the mounting of a new unit thereon. The diameter of the ink roll means 30 is slightly smaller than the internal diameter of the cover 12 when viewed from the assembled relationship shown in FIG. 4 so as to facilitate the mounting of the ink roll means 30 and cover 12 on the supporting rod 38. When the ink roll means 30 is to be brought into cooperative relationship with the ink roller 82, the lever 78 is simply rotated in a clockwise direction, as viewed in FIG. 4, and the tension spring 84 resiliently biases the ink roll means 30 into engagement with the inking roller 82. This inking roller 82 is fixed to a shaft 85 which is rotatably mounted in the supporting frame 70 and which is also rotatably driven by a drive mechanism not shown. As the inking roller 82 is rotated, it will also rotate the ink roll means 30 so as to present a fresh supply of ink to the endless ribbon 86 which is sandwiched between the ink roll means 30 and the inking roller 82. The endless ribbon 86 is also supported on the idler rollers 88 and 90. As the ink roller 82 is rotated, the endless ribbon 86 is constantly moved and replenished by a fresh supply of ink when the ribbon comes in contact with the ink roll means 30. Printing on the record medium 92, which is positioned below the inking ribbon 86, is effected by a conventional print head or print member shown as block 94 and a platen 96. Because the portion of the printer shown in FIG. 4 may be conventional, it need not be described in any detail. The ink roll means 30 may be of the type which is a conventional porous ink roll which contains the ink in the pores of the ink roll itself.

What is claimed is:

1. A supporting cover for an ink roll means comprising:

first and second sections and a hinge means to enable said first and second sections to be moved relative to each other to form a generally hollow container when in assembled relationship, to receive said ink roll means therein;

at least one of said first and second sections having means enabling said ink roll means to be rotatably supported in said supporting cover;

at least one of said first and second sections having a portion removed therefrom to expose a portion of said ink roll means when mounted in said supporting cover; and said supporting cover having thereon means for restraining movement thereof when installed on a cooperating utilization device.

2. The cover as claimed in claim 1 in which said first and second sections, said hinge means and said restraining means are formed of a unitary piece of plastic material.

3. The cover as claimed in claim 2 in which said first and second sections each have first and second end walls in spaced parallel relationship with each other; and at least said first end walls of said first and second sections have cooperating locking means thereon for locking said first and second sections in said assembled relationship.

4. A supporting cover for an ink roll comprising:

first and second hollow halves having a hinge means to enable the first and second halves to be moved relative to each other to form a generally, cylindrically-shaped hollow container when in assembled relationship to receive said ink roll therein;

said first and second halves each having aligned areas therein wherein portions thereof are removed therefrom to receive a supporting rod to thereby enable said ink roll to be rotatably supported in said supporting cover when said first and second halves are moved into said assembled relationship with said ink roll therein; and means for locking said first and second halves in said assembled relationship;

said cover having thereon means for restraining the rotation of said cover when it is installed on a utilization device, and said cover having a portion thereof removed therefrom to expose a portion of said ink roll when mounted therein.

5. The supporting cover as claimed in claim 4 in which said supporting cover has a longitudinal axis when in said assembled relationship, which said longitudinal axis is coincident with the longitudinal axis of said supporting rod which enables said ink roll to be rotatably mounted in said supporting cover.

6. The supporting cover as claimed in claim 5 in which said first and second halves each have first and second end walls in spaced parallel relationship to each other;

said locking means including first and second projections extending from each of said first and second end walls of said first half, and first and second plates extending from said first and second end walls of said second half, said first and second plates each having complementary recesses therein to receive said first and second projections to thereby lock said first and second halves together when in said assembled relationship.

7. The supporting cover as claimed in claim 6 in which said restraining means includes third and fourth projections which extend outwardly of said supporting cover from said first end walls of said first and second halves and which said third and fourth projections are located on a diametral line passing through said longitudinal axis and being perpendicular thereto.

8. A supporting cover for an ink roll comprising:

first and second hollow halves having a hinge means to enable the first and second halves to be moved relative to each other to form a generally, cylindrically-shaped hollow container when in assembled relationship to receive said ink roll therein;

said first and second halves each having aligned areas therein wherein portions thereof are removed therefrom to receive a supporting rod to thereby enable said ink roll to be rotatably supported in said supporting cover when said first and second halves are moved into said assembled relationship with said ink roll therein; and means for locking said first and second halves in said assembled relationship;

said cover having thereon means for restraining the rotation of said cover when it is installed on a utilization device, and said cover having a portion thereof removed therefrom to expose a portion of said ink roll when mounted therein;

said supporting cover having a longitudinal axis when in said assembled relationship, which said longitudinal axis is coincident with the longitudinal axis of said supporting rod which enables said ink roll to be rotatably mounted in said supporting cover;

said first and second halves each having first and second end walls in spaced parallel relationship to each other;

said locking means including first and second projections extending from each of said first and second end walls of said first half, and first and second plates extending from said first and second end walls of said second half, said first and second plates each having complementary recesses therein to receive said first and second projections to thereby lock said first and second halves together when in said assembled relationship;

said restraining means including third and fourth projections which extend outwardly of said supporting cover from said first end walls of said first and second halves and which said third and fourth projections are located on a diametral line passing through said longitudinal axis and being perpendicular thereto; and said first and second halves, said hinge means, said locking means and said restraining means being formed of a unitary piece of plastic material such as polypropylene, and said hinge means being located along a line which is parallel to said longitudinal axis.

9. A blank formed of a single piece of material for use as a cover for an ink roll comprising:

first and second halves having an integrally formed hinge pivotally joining said first and second halves, with said first and second halves being shaped to form a generally, cylindrically-shaped hollow container when said first and second halves are moved relative to each other along said integrally formed hinge to an assembled relationship;

said first and second halves each having aligned areas therein wherein semi-circular portions are removed therefrom to receive a supporting rod on which said ink roll may be rotatably supported;

said first and second halves having cooperating locking means thereon to lock said first and second halves in said assembled relationship;

said first and second halves each having a portion removed therefrom to expose a portion of said ink roll when positioned in said container which is formed when said first and second halves are moved to said assembled relationship; and said first and second halves having thereon means for restraining movement of said first and second halves when in said assembled relationship relative to a utilization device.

10. A package comprising:

a porous ink roller having a mounting aperture therein;

first and second halves and a hinge means to enable said first and second halves to be moved relative to each other to form a generally, cylindrically-shaped hollow container when in assembled relationship to receive said porous ink roller, said first and second halves having means for rotatably supporting a supporting rod on which said porous ink roller may be mounted;

said first and second halves each having a portion removed therefrom to expose a portion of said porous ink roller from said container so formed;

said first and second halves having thereon means for restraining rotational movement thereof when installed on a cooperating device; and said first and second halves having cooperating locking means to lock said first and second halves in said assembled relationship with said porous ink roller therein;

said first and second halves, said hinge means, said supporting means, said restraining means and said cooperating locking means being formed of a single piece of plastic material.

11. The package of claim 10 in which said container so formed with said porous ink roller being located therein has a layer of plastic material surrounding them.

* * * * *